United States Patent [19]

Hitchins

[11] Patent Number: 4,627,205

[45] Date of Patent: Dec. 9, 1986

[54] BUILDING FOUNDATIONS INVENTION

[76] Inventor: William G. Hitchins, "Fiddawn", New Cascade Road, 2899

[21] Appl. No.: 758,082

[22] Filed: Jul. 23, 1985

[30] Foreign Application Priority Data

Jul. 23, 1984 [AU] Australia ..... PG6164

[51] Int. Cl.[4] ..... E02D 27/00

[52] U.S. Cl. ..... 52/294; 52/169.9

[58] Field of Search ..... 52/681, 295, 167, 169.8, 52/169.9, 726, 365, 677, 679, 687, 369, 370, 102; 249/4, 34, 91, 93

[56] References Cited

U.S. PATENT DOCUMENTS

| | | | |
|---|---|---|---|
| 1,700,889 | 2/1929 | Heltzel | 249/4 |
| 2,815,656 | 12/1957 | Klein et al. | 52/169.9 X |
| 3,197,171 | 7/1965 | Michalak | 249/91 X |
| 3,395,884 | 8/1968 | Laukala | 249/4 |
| 4,125,980 | 11/1978 | Miraldi | 52/169.9 X |

FOREIGN PATENT DOCUMENTS

| | | | |
|---|---|---|---|
| 3202014 | 8/1983 | Fed. Rep. of Germany | 52/677 |

*Primary Examiner*—William F. Pate, III
*Assistant Examiner*—Creighton Smith
*Attorney, Agent, or Firm*—Anthony A. O'Brien

[57] ABSTRACT

A form for in-situ casting of concrete foundations is disclosed as associated with a pair of sacrificial adjuncts including elongated metal side members extending upwardly from flanges thereon and inwardly toward each other, a plurality of width control rods each having one end projecting through one flange and a second end projecting through the other flange, a series of horizontal webs joins the top sections of the metal side members; a plurality of reinforcing rods are positioned between the two metal side members and are maintained vertically and horizontally in spaced relation to each other by a plurality of horizontally spaced inverted V-shaped, reinforcing pins, each of which has a plurality of generally circular loops encircling the corresponding plurality of reinforcing rods, and a hook bolt extending from an uppermost reinforcing rod through its corresponding horizontal web to receive a retaining nut.

4 Claims, 3 Drawing Figures

-FIG. 1-
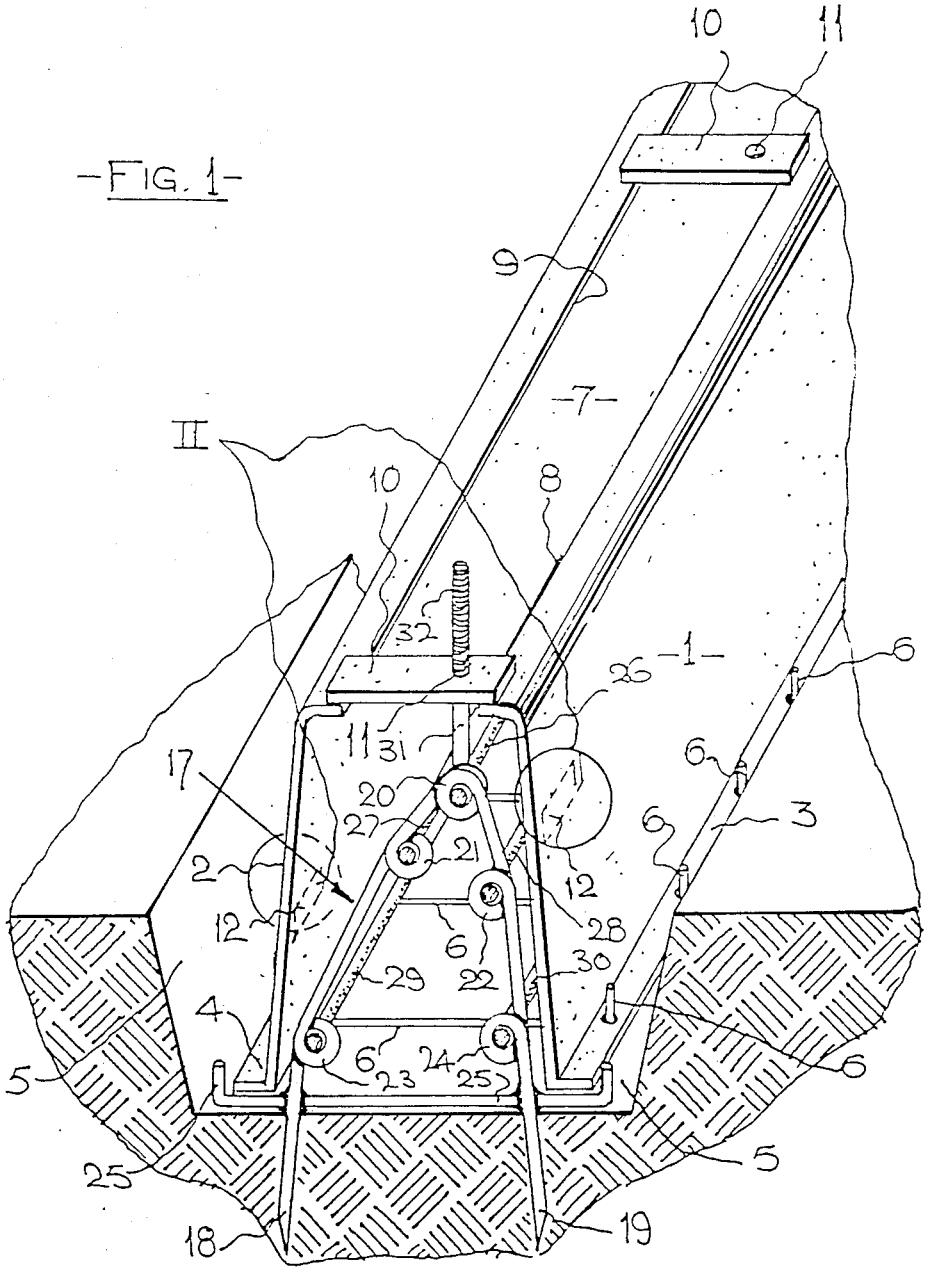

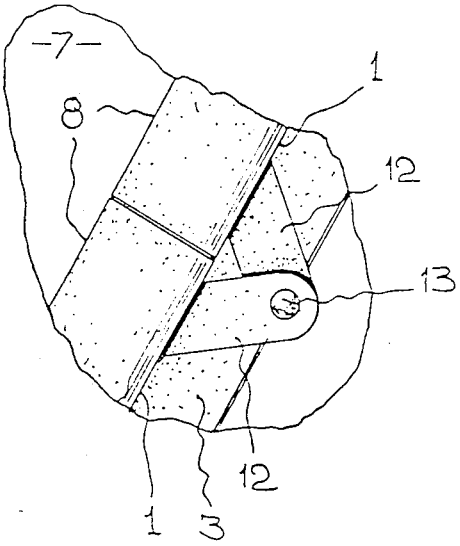
-FIG. 2-
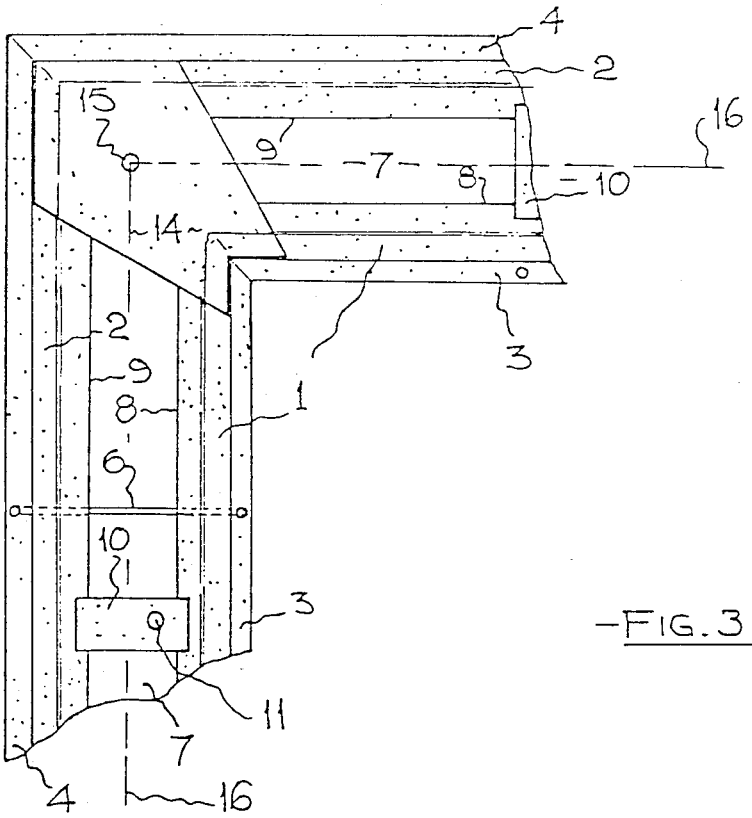
-FIG. 3-

BUILDING FOUNDATIONS INVENTION

This invention relates to foundations for buildings, and more particularly to foundations to which a building construction can be bolted.

Traditional methods of building construction are such that labour costs cannot be reduced to any significant degree and, moreover, the inherently-expensive traditional building materials are only too prone to deterioration, damage by fire or water etc. and usually require constant and regular maintenance.

There again, many parts of the world are subject to recurring hurricanes, typhoons, earthquakes and tremors, volcanic action and to heavy flooding. In the foreknowledge of such natural disasters it is quite astonishing that, even today, the weight of a building—particularly in the case of domestic dwellings—is generally relied on to withstand such conditions as mentioned above. That a house's weight is all too often woefully inadequate to confer the required stability is evinced, for example, by the many dwellings destroyed each year by hurricanes and like disturbances which literally blow the house off its foundations.

It is thus an object of the present invention to overcome the above and other disadvantages by providing concrete foundations or footings to which the fabric of a building may be rigidly secured instead of merely 'sitting' upon them in the conventional manner.

To this end therefore, the present invention consists in a forme for the casting of concrete foundations in situ, and having a plurality of sacrificial adjuncts associated with it; the arrangement being such that, when a concrete foundation has been cast within the forme and the concrete has become cured, the forme can be lifted off the mass of cured concrete to permit a building structure to be rigidly secured to the foundation via certain of the sacrificial adjuncts which are now embedded in the concrete of the foundation.

Thus, there is provided in combination, a forme for in-situ casting of concrete foundations, and a plurality of associated sacrificial adjuncts; comprising a pair of elongated side members disposable parallel to each other with their ends generally in register, said side members being so disposable as to extend upwardly and inwardly with respect to each other; horizontal flanges extending outwardly from bases of said side members and having therein a plurality of apertures through which bent-up ends of a corresponding plurality of width-control rods are receivable; at least two web members connecting upper edges of said side members, each said web member being provided with an aperture therethrough; a plurality of reinforcement-positioning pins, each of inverted V-shape, the ends of the limbs thereof being insertable into the ground; a plurality of reinforcing rods adapted to extend through loops in said reinforcement-positioning pins in parallel array; and a hook-bolt associated with each said web member the bight of said hook-bolt being such as to fit around a said reinforcing rod and the shank of which is extendable upwardly through the aperture of the said web member, said shank being externally threaded so as to accept a co-operating nut.

Each reinforcement-positioning pin may have, affixed across its limbs, a height-control bar which is positionable upon the ground between the side members, and is preferably formed with a loop at is apex and with at least one loop in each limb, each loop being adapted to receive therethrough a reinforcement rod.

Ideally, at each end of each side member is a lug which is matable with a like lug provided on a side element of a second forme.

In a further aspect, the present invention consists in a concrete foundation, whenever it is cast in-situ using a forme and associated sacrificial adjuncts.

In order that the reader may gain a better understanding of the present invention, hereinafter will be described a preferred embodiment thereof, by way of example only, and with reference to the accompanying drawings in which:

FIG. 1 is an isometric drawing showing the invention set up ready for the pouring of concrete;

FIG. 2 shows a detail indicated by the lead lines II of FIG. 1; and

FIG. 3 is a top plan view of a corner arrangement.

Throughout the drawings, like integers are referred to by the same number.

From the drawings it will be seen that the forme according to the present invention may comprise a pair of elongated metal members 1 and 2 disposable parallel to each other with their ends generally in register. These two members 1 and 2 extend upwardly and inwardly with respect to each other in such a way that a transverse cross section defines a fusto-cone having an open base and top. Extending along the base sides of members 1 and 2 are, respectively, horizontally-disposed flanges 3 and 4 adapted to support the forme, ideally at the bottom of a suitable trench 5. To ensure that members 1 and 2 are not caused to spread when concrete is poured into the forme, they are 'tied together' at the bottom by means of a plurality of width-control rods 6 which engage in co-acting holes in flanges 3 and 4. Thus the top sides of the two elongated metal members 1 and 2 define a slot 7 considerably narrower, between its inturned edges 8 and 9, than the width between the horizontally-disposed flanges 3 and 4, and this slot is spanned by a series of horizontal plates or webs 10 spaced perhaps about two to four feet apart; that is to say, the top sides of the forme are connected by the said webs 10. Each web 10 is provided with an aperture 11 for a purpose later to be described herein. Thus, the forme constitutes a fairly rigid shell, open at its ends and base, but with a number of discrete slots along its top, defined by the top edges 8 and 9 and the spanning webs 10.

The above-described forme may be linearly aligned with another such forme by means of pairs of apertured lugs 12 which are mounted upon the outer surfaces of the elongated metal members 1, 2 so that when the ends of two linearly-aligned formes are juxtaposed in abutting relationship—as shown best in FIG. 2—a pin or rod 13 may be used to join co-acting lugs 12. Furthermore, two of the inventive formes may be accurately juxtaposed in 90° register, as illustrated in FIG. 3 of the drawings by the use of shaped corner-pieces 14. Each corner-piece 14 is provided with a hole 15 on the centrelines 16 of the two adjoining formes, for a purpose later to be described herein.

Each of the formes as has been hereinbefore described has associated with it a plurality of sacrificial adjuncts; by the term 'sacrificial' is meant that these adjuncts eventually become embedded in, and so become a part of, the concrete building foundation which is to be cast in the said forme. These sacrifical adjuncts are of four species: the width-control rods 6 (previously described); reinforcement-positioning pins; reinforcing rods and hook-bolts.

Each reinforcement-positioning pin—generally referenced 17—may be made from, say, ½ inch diameter metal rod bent into the shape of an inverted V, the ends of the two limbs, 18, 19 being pointed to enable the member to be driven into the ground. The apex of the member 17 is formed with a circular loop 20 and its limbs may each also have one or more similar circular loops, as 21, 22, 23 and 24. Thus, a reinforcement-positioning pin 17 can have, perhaps, either three, five, six or seven such loops formed in it, the whole being bent from a suitable length of the metal rod. Welded, or otherwise rigidly-affixed, to the limbs 18, 19 of the reinforcement-positioning pin 17 may be a height-control bar 25 which aids in the vertical positioning of the array of reinforcement-positioning pins.

The reinforcing rods, 26, 27, 28, 29 and 30, are lengths of quite conventional concrete-reinforcing rodding, and the circular loops described above in relation to the reinforcement-positioning pins—as 17—should have their internal diameters such that the reinforcing rods—as 26 to 30—are able to extend through them.

The hook-bolts, one example of which is referenced 31, have, at one end, a hook the bight of which is of such a dimension as to fit around a said reinforcing rod. The other end of each hook-bolt—as referenced 32—is externally threaded to accept a co-operating nut, and the diameter of these hook-bolts is such that they are adapted to pass through the previously-mentioned apertures 11 and 15 in plates or webs 10 and corner-piece 14, respectively, which connect the tops of the elongated metal members of the formes.

Concrete foundations according to the present invention may be cast by employing the above-described formes and their sacfificial adjuncts according to the following method: firstly a trench—as 5—is excavated to an extent corresponding to the required foundation; this trench may be, say, 2 feet in width and from 6 to 12 inches deep, depending on the kind of soil obtaining and on the climatic conditions endemic to the region. The above, of course, is assuming a normal, reasonably flat building site.

A string line is then positioned in the trench along the notional centre-line of the proposed wall of the building and perhaps 6 inches below its notional base-line, ensuring that the string line is levelled so as to be as near to the absolute horizontal as is possible.

Reinforcement-positioning pins—as 17—are then driven into the floor of the trench 5 at, say, 2 to 4 foot intervals so that the tops—that is to say, the apices—of all the reinforcement-positioning pins just touch the string, aided by height-control bars 25, so that those loops 20 of the pins 17 are located directly below the sting.

Lengths of the reinforcing rodding—as referenced 26 to 30—are then passed through the loops in the reinforcement positioning pins and abutted end-to-end over the whole of the length of the trench; thus there may be five, or even more, series of reinforcing rods within the trench, each series being horizontally aligned by virtue of their being supported in registering (i.e. linearly-aligned) loops of the reinforcement-positioning pins.

An elongated metal forme comprising the pair of elongated metal elements 1 and 2, 'tied together' by webs 10 and width-control rods 6, is then positioned in trench 5, over the array of reinforcement-positioning pins and aligned reinforcing rods, so that the holes 11 in the plates or webs 10 are exactly in alignment with the string line corresponding to the proposed wall line of the building.

A hook-bolt, as 31, is passed down into the trench, and the hooked end thereof is placed around the uppermost reinforcing rod 26 as the threaded shank 32 is thrust upwardly through aperture 11 in web 10. A collar or washer is then placed over the threaded, upper end of the hook-bolt, now protruding upwardly through the web, offset from its centre, and a nut is screwed onto threaded end 32 and hand-tightened down onto the washer and the web or plate 10.

In the case of the corners, corner pieces such as 14 are employed and hook-bolts are hooked about the reinforcing rods 27—supported in the circular loops such as 21—and are then extended upwardly through the centrally-located holes 15 in these corner-pieces. Thence the procedure is as before.

Concrete may now be poured into the formes up to the level of top edges 8 and 9, and the upper surface of the concrete mass screeded to impart to it as smooth a surface as possible.

When the concrete foundation so produced has set or 'cured' to the required degree, the nuts and collars or washers are removed for further use and the forme lifted off the now-hardened foundation, which operation is easily accomplished by virtue of the frusto-conical transverse cross-section of the forme.

Thus there has been produced a concrete foundation in which the four species of sacrificial adjuncts—i.e. width-control rods, reinforcement-positioning pins, reinforcing rods and hook-bolts—are embedded. The threaded ends of the hook-bolts project upwardly to enable the frame members of a building, to be constructed on the foundation, to be firmly bolted down onto it instead of merely resting upon it and being held thereto only by its own mass. The volume of the trench which remains unencumbered by the foundation may now be filled with rubble or in-fill or soil etc. up to general ground level.

From the abovegoing the reader will appreciate that formes for the casting of concrete foundations in accordance with the present invention, and concrete foundations so cast, provide the public with a new or much-improved article and a method of great use to the building industry or, at the very least, offer to it a most useful and very attractive choice.

I claim:

1. In combination, a form for in-situ casting of concrete foundations, and a plurality of associated sacrificial adjuncts; comprising a pair of elongated side members disposable parallel to each other with their ends generally in register, said side members being so disposable as to extend upwardly and inwardly with respect to each other; horizontal flanges extending outwardly from bases of said side members and having therein a plurality of apertures through which bent-up ends of a corresponding plurality of width-control rods are receivable; at least two web members connecting upper edges of said side members, each said web member being provided with an aperture therethrough; a plurality of reinforcement-positioning pins, each of inverted V-shape and each having limbs with ends being insertable into the ground; a plurality of reinforcing rods adapted to extend through loops in said reinforcement-positioning pins in parallel array; and a hook-bolt associated with each said web member and having a bight adapted as to fit around a said reinforcing rod and having a shank extendable upwardly through the aperture of the said web member, said shank being externally threaded so as to accept a co-operating nut.

2. The combination as claimed in claim 1, wherein each reinforcement-positioning pin has, affixed across the said limbs thereof, a height-control bar positionable upon the ground between said pair of elongated side members.

3. The combination as claimed in claim 1, wherein each said reinforcement-positioning pin is formed with a loop at the apex thereof and with at least one loop in each said limb thereof, each loop being adapted to receive therethrough a said reinforcement rod.

4. The combination as claimed in claim 1 wherein each end of a said elongated side member is provided with a lug matable with a like lug provided on a side element of a second forme disposed in linear alignment.

* * * * *